US005954918A

United States Patent [19]

Belivakici

[11] Patent Number: 5,954,918

[45] Date of Patent: Sep. 21, 1999

[54] TAPE WRAPPING MACHINE

[75] Inventor: Thomas U. Belivakici, Hanover, Pa.

[73] Assignee: CAM Industries, Inc., Philadelphia, Pa.

[21] Appl. No.: 08/927,424

[22] Filed: Sep. 11, 1997

[51] Int. Cl.[6] ..... B32B 35/00

[52] U.S. Cl. ..... 156/468; 156/475; 156/486; 156/494; 156/510; 156/522

[58] Field of Search ..... 156/443, 446, 156/459, 468, 510, 522, 494, 475, 392, 352, 358, 363, 365, 368, 486; 53/587, 588, 589

[56] References Cited

U.S. PATENT DOCUMENTS

| | | | |
|---|---|---|---|
| 1,837,840 | 12/1931 | Slusher . | |
| 1,944,142 | 1/1934 | Abbott, Jr. et al. . | |
| 2,834,499 | 5/1958 | Semkow . | |
| 2,909,019 | 10/1959 | MacBride . | |
| 3,031,368 | 4/1962 | Zent . | |
| 3,245,860 | 4/1966 | Aurich et al. . | |
| 3,321,352 | 5/1967 | Sejda . | |
| 3,337,103 | 8/1967 | Walus et al. . | |
| 3,414,451 | 12/1968 | Sejda . | |
| 3,418,358 | 12/1968 | Sejda . | |
| 3,547,737 | 12/1970 | Vici . | |
| 4,204,905 | 5/1980 | Miyamoto . | |
| 4,236,536 | 12/1980 | Waegaert . | |
| 4,264,398 | 4/1981 | Pruitt | 156/468 |
| 4,316,760 | 2/1982 | Satomi | 156/468 |
| 4,360,400 | 11/1982 | Davis et al. | 156/468 |
| 4,602,976 | 7/1986 | Fukuda et al. . | |
| 4,790,896 | 12/1988 | Schmalholtz | 156/468 X |
| 4,961,815 | 10/1990 | Buckley et al. . | |

FOREIGN PATENT DOCUMENTS

| | | |
|---|---|---|
| 55-66467 | 5/1980 | Japan . |
| 170324 | 3/1989 | Japan . |

*Primary Examiner*—Curtis Mayes
*Attorney, Agent, or Firm*—Sixbey, Friedman, Leedom & Ferguson, P.C.; Tim L. Brackett, Jr.

[57] ABSTRACT

An improved tape wrapping machine is provided which includes a tape slack device for creating a predetermined amount of untensioned slack in the tape web at the end of each cycle of operation to prevent the need for the operator to pull the tape from the supply roll at the beginning of the next taping cycle. The tape slack device includes a slack arm mounted for pivotal movement between tension and slack positions to create the necessary slack without movement of the tape supply roll. A tape feed support/slide and a retractable knife operate to effectively cut the web of tape during each cycle while creating an end portion of the tape for contact by the article during the next taping operation. The knife device is positioned to cut the nonadhesive side of the tape thereby permitting uninterrupted taping operations. A tape wrap collet includes elastomer fingers ensuring the tape conforms to the outer surface of the article thereby creating a tight tape wrap.

20 Claims, 6 Drawing Sheets

TAPE WRAPPING MACHINE

TECHNICAL FIELD

The present invention relates to taping machines and more particularly to a spot taping apparatus for applying adhesive tape or other binding material to an article, such as a plurality of wires, for the purpose of, for example, holding the wires together.

BACKGROUND OF THE INVENTION

Electrical wiring harnesses are commonly used in the automotive, electrical appliance and many other fields. Such a harness consists of an assembly of wires cut to the proper lengths and assembled in a group or bundle which can be easily installed in the apparatus being manufactured and which greatly simplifies the electrical wiring thereof. In the manufacture of these harnesses, a group of wires of proper size and length is assembled together and then spot taped at a number of points along its length by wrapping several turns or wraps of tape around the group or bundle of wires. After this "spot" taping operation, the harness may either be taped throughout its length or may be installed directly in its place of use without further taping.

U.S. Pat. No. 4,961,815 to Buckley et al. discloses a tape wrapping apparatus for wrapping a bundle of wires which includes a rotatable head having a slot for receiving a bundle of wires and rotating to wrap tape around the wires. A tape handling mechanism uses a slide and a take-up arm which operate to provide stored tape to the head without requiring tape to be pulled from a supply reel during insertion and wrapping of the wire bundle. Also, a knife is used to cut the tape prior to rotation of the head. However, this machine requires the entire frame and reel to be moved relative to the bundle to cause engagement of the wire bundle in the head. In addition, the entire supply reel must be moved relative to the rotatable head to provide the tape slack for the next cycle of operation, thereby requiring an excessively complex device and process. Also, the tape cutting knife is stationary thereby requiring delicate manipulation of the tape to achieve successful cutting. The knife also disadvantageously cuts the adhesive side of the tape possibly causing the tape to adhere to the knife resulting in interruptions in the tape process.

U.S. Pat. No. 3,414,451 to Sejda discloses an apparatus for wrapping pressure sensitive tape around a bundle of wires which includes a tape feeding mechanism having a pivotally mounted stripper lever for supporting a supply reel of tape. A crank lever pivots the stripper lever when a wrapping chuck is rotated to create a slack portion or loop of tape adjacent the tape reel. As a result, the tape is pulled from the reel only if tape is actually used. However, the whole supply reel must be moved to create slack in the tape thereby creating an unnecessarily complex device and operation process. Moreover, this apparatus uses a knife to cut the adhesive side of the tape thus possibly resulting in undesirable interruptions in the process due to the tape adhering to the knife. Also, this apparatus fails to include a protective device for preventing damage to a user's fingers by inadvertent insertion of the fingers into the machine.

Consequently, there is a need for a tape wrapping machine which is simple, inexpensive yet capable of effectively wrapping tape around an article while minimizing both the complexity of the machine and the effort required by the user of the machine.

SUMMARY OF THE INVENTION

It is an object of the invention, therefore, to overcome the disadvantages of the prior art and to provide a tape wrapping machine capable of effectively and reliably wrapping tape around an article.

It is another object of the present invention to provide a tape wrapping machine which minimizes the effort and strain on the operator by avoiding the need to pull tape from the supply roll.

It is yet another object of the present invention to provide a tape wrapping machine which effectively provides slack along the tape feed path.

It is a further object of the present invention to provide a tape wrapping machine which reduces the opportunity for tape misfeed due to the tape pulling off of the article to be taped during feeding because of excessive tension on the supply roll.

It is a still further object of the present invention to provide a tape wrapping machine which effectively cuts the tape while minimizing the likelihood of the tape adhering to the machine during cutting operations thereby minimizing interruptions in the taping process.

Still another object of the present invention is to provide a tape wrapping machine including a cutting device which cuts the tape on a nonadhesive side while the tape is under tension.

Yet another object of the present invention is to provide a tape wrapping machine which tightly wraps the tape around the article so as to avoid an incomplete or loose wrap.

A still further object of the present invention is to provide a tape wrapping machine which reduces the risk of injury to the operator.

It is yet another object of the present invention to provide a tape wrapping machine which reduces operator fatigue by minimizing the movements required by the operator to complete a tape wrapping cycle.

It is a further object of the present invention to provide a tape wrapping machine which automatically initiates operation and resets to a ready position when the tape is moved into and out of, respectively, the machine.

It is yet another object of the present invention to provide a tape wrapping machine which permits the length of the cut tape to be varied according to the size of the article to be taped.

These and other objects of the present invention are achieved by providing a tape wrapping machine or apparatus for wrapping pressure sensitive tape around an article, comprising a support frame, a tape supply mounted on the support frame for providing a web of tape for movement along a feed path and a tape wrap collet rotatably mounted on the frame at a fixed spaced distance from the tape supply for receiving the article and wrapping a cut length of tape around the article. The wrapping machine includes a tape slack device for creating a predetermined amount of untensioned slack in the tape web along the feed path while maintaining the fixed spaced distance between the tape wrap collet and the tape supply. The tape slack device includes a slack arm pivotally mounted on the support frame for abutment against the tape web. The slack arm is movable between a first position maintaining tension in the tape web and a second position creating untensioned slack in the tape web.

The wrapping machine may further include a tape feed support for supporting the tape web adjacent the tape wrap collet. The tape feed support includes a feed slide reciprocally mounted for movement between an extended position supporting the tape web and a retracted position creating an unsupported end portion of the tape web. The slack arm may be pivotally connected to the feed slide so that movement of the feed slide toward the retracted position causes movement of the slack arm toward the second position. A feed slide cam functions to move the feed slide between the extended and retracted positions and thus move the slack arm between the first and second positions.

A tape cutting device may be mounted on the machine and positioned for cutting a nonadhesive side of the tape web. The cutting device may include an elongated knife reciprocally mounted adjacent the feed slide and a knife cam device for moving the knife between a first position and a second position. Movement of the knife into the second position causes the knife to cut the tape web thereby allowing the cut length of tape to be wrapped around the article by the tape wrap collet. The knife cam device moves the knife into the second position when the feed slide is in the extended position so as to cut the tape web. The tape wrap collet may include resilient grasping fingers or loops for grasping the article to be wrapped. Preferably, the resilient grasping fingers are formed at least partially of a compliant or pliable material, such as an elastomer, foam, or plastic material, for contacting the article so as to ensure a secure and tight wrap. A collet rotating device is provided for rotating the tape wrap collet upon actuation of the machine. A safety guard and actuation device is pivotally mounted on the support frame for movement between a closed position blocking access to the tape wrap collet and causing actuation of the collet rotating device, and an open position. The safety guard and actuation device is mounted so that movement of the article into the tape wrap collet causes movement of the safety guard and actuation device from the open position to the closed position while movement of the article out of the tape wrap collet causes movement of the safety guard and actuation device from the closed position to the open position. The knife cam device may include an adjusting device for permitting adjustment in a timing of the movement of the knife into the second position relative to rotation of the tape wrap collet so as to vary the length of the cut tape.

DETAILED DESCRIPTION OF THE PREFERRED EMBODIMENT

Figure 1:
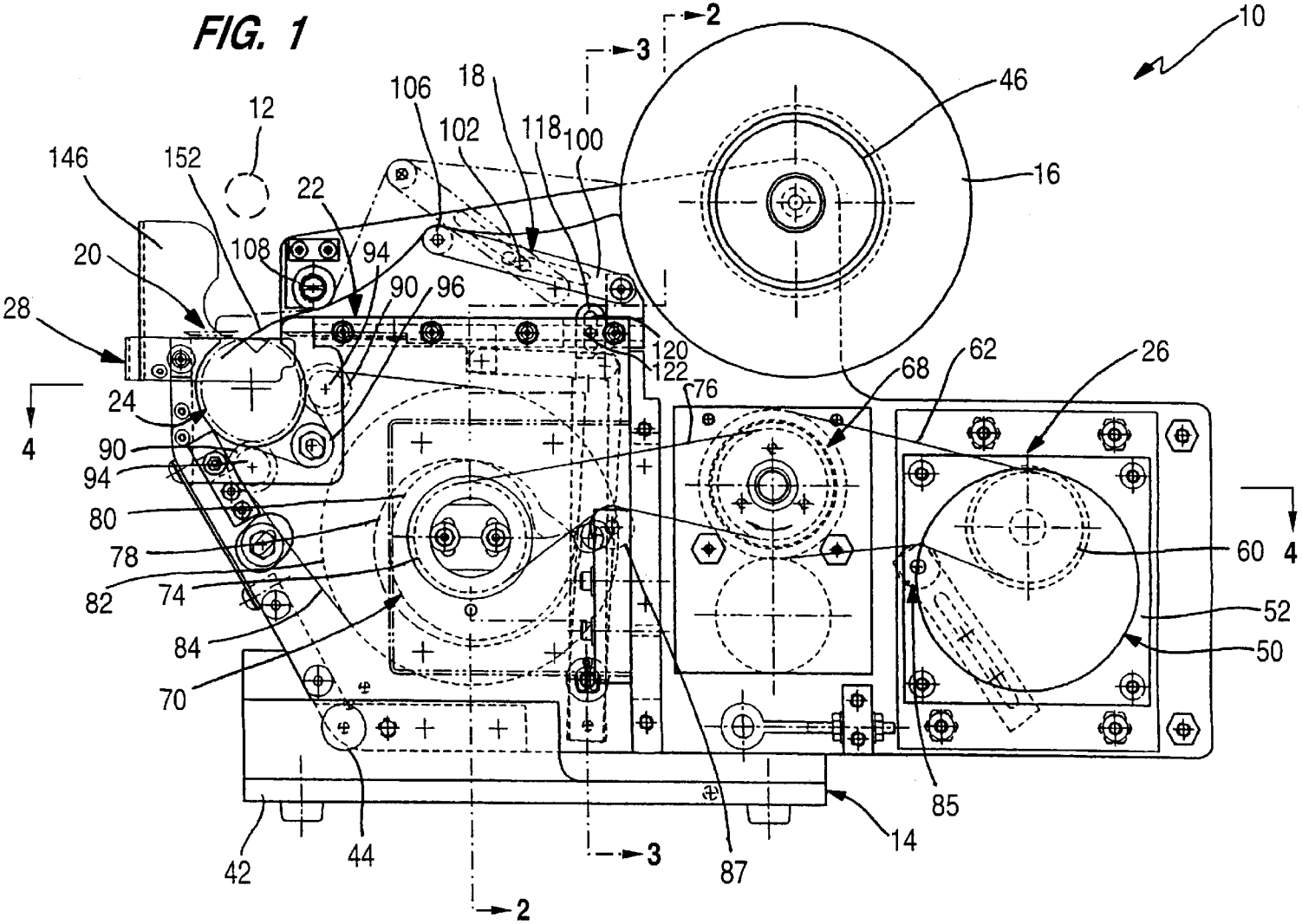
FIG. 1 is a side elevation view of the tape wrapping machine of the present invention.

Referring to FIG. 1, there is shown the tape wrapping machine of the present invention indicated generally at 10 for effectively and reliably cutting and wrapping a predetermined length of tape around an article 12, such as a bundle of wires. Tape wrapping machine 10 generally includes a support frame 14, a supply roll of tape 16 mounted on support frame 14, a tape slack device 18 for controlling the slack in the tape being dispensed from supply roll 16, a cutting device 20 for cutting the web of tape to create a cut piece of tape having a predetermined length, a tape feed support device 22 for supporting the tape during cutting, a tape wrap collet 24 for wrapping the cut length of tape around article 12, a drive system 26 for causing movement of the various components of machine 10 and a combination safety guard and actuating device 28 for selectively actuating and deactuating drive system 26. These components operate together to cause the automatic cutting of the tape and wrapping of article 12 with a cut length of tape upon insertion of article 12 into tape wrap collet 24 while minimizing the effort required by the operator in each cycle of operation.

Figures 4, 5:
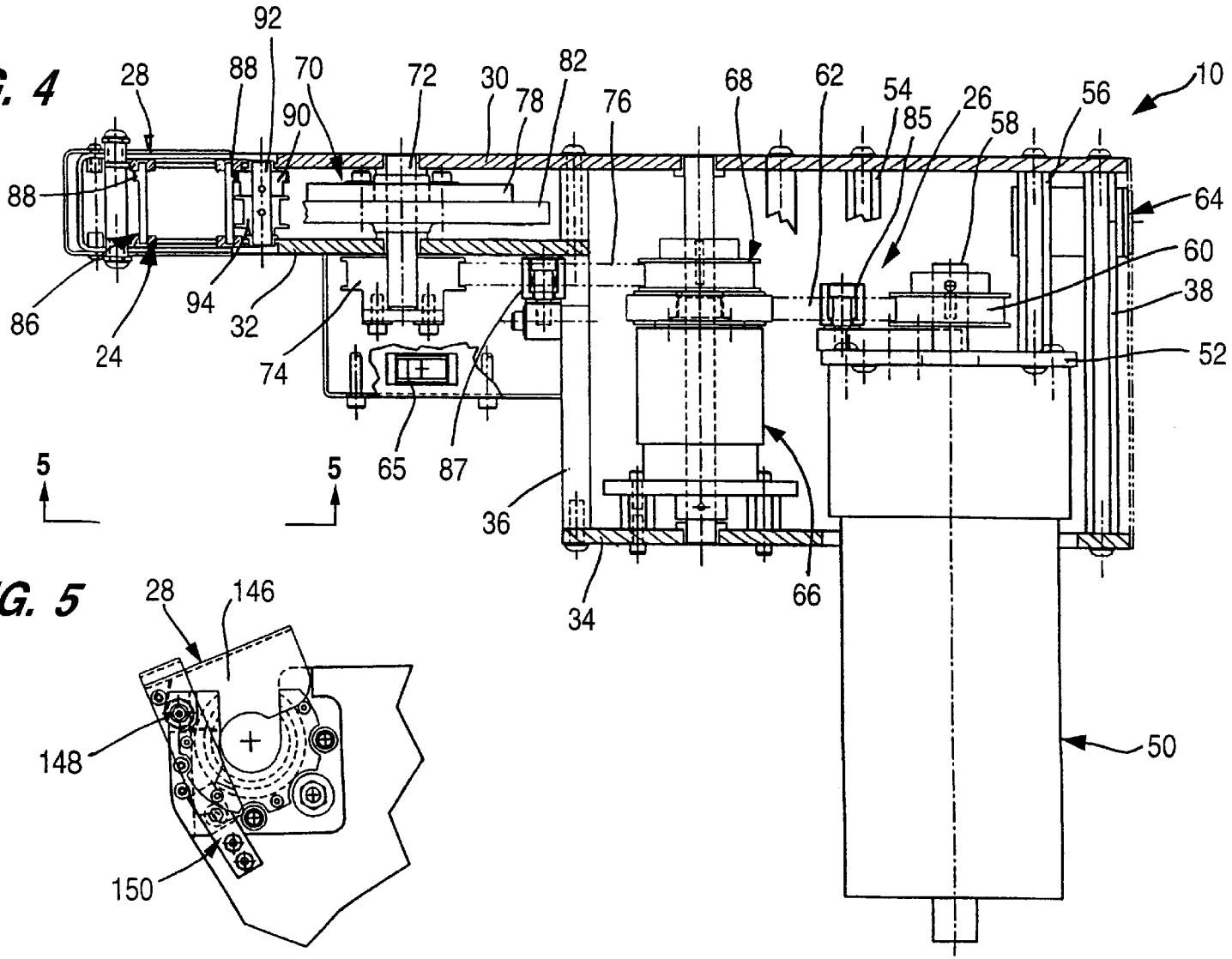
FIG. 4 is a cross sectional view of the tape wrapping machine of the present invention taken along plane 4—4 of FIG. 1.
FIG. 5 is a cut-away side elevational view of the tape wrap collet and safety guard/actuator device of the present tape wrapping machine taken along plane 5—5 of FIG. 4.

Support frame 14 includes a first side plate 30 extending along one side of machine 10 and a second side plate 32 mounted in spaced parallel relationship to first plate 30 as shown in FIG. 4. A third support plate 34 is positioned on one side of second side plate 32 opposite first side plate 30 and connected to first and second side plates 30, 32 by a support plate 36 at one end and connected to first side plate 30 by a support tube 38. Bolts are threaded into each end of support plate 36 and support tube 38 to secure plates 30, 32 and 34 in fixed relative position to one another. Support frame 14 also includes first and second foot flanges 40 and 42, respectively, which are secured to the lower end of first and second side plates 30, 32 by a releasable bolt assembly 44. Foot flanges 40, 42 extend along the lower surface of support frame 14 to provide stable support to the tape wrapping machine 10.

Figure 2:
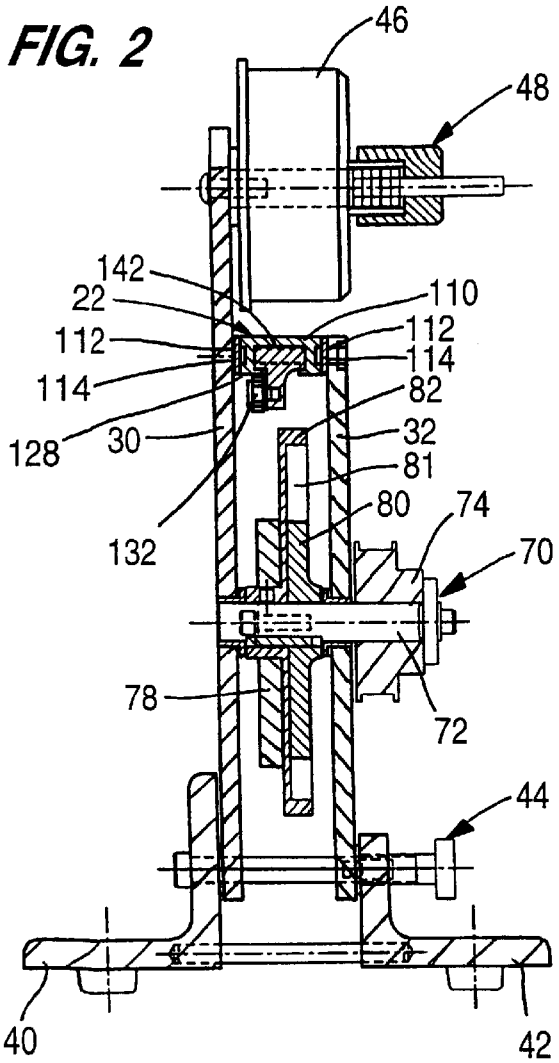
FIG. 2 is a cross sectional view of the tape wrapping machine of the present invention taken along plane 2—2 of FIG. 1.

As shown in FIG. 2, first side plate 30 extends upwardly to form a support for a tape spool 46 rotatably mounted on first side plate 30 for receiving tape supply roll 16. Tape spool 46 is preferably provided with a friction brake mechanism 48 for preventing tape supply roll 16 from rotating in either direction beyond the desired amount as the tape is pulled from roll 16. As a result, only the proper amount of tape is pulled from supply roll 16 as dictated by the operation of the downstream components as discussed more fully hereinbelow, and without the adverse effect of the rolling momentum of tape supply roll 16.

Referring to FIGS. 1 and 4, drive system 26 includes a drive motor 50 securely connected to a motor support plate 52 and extending transversely outwardly through support plate 34. Motor support plate 52 is connected to first side plate 30 via at least two support spacers 54, 56. Motor 50 includes a rotatable shaft 58 and pulley 60 extending from one end for operating a timing belt 62. An electrical connector 64 is mounted on support frame 14 for providing a connection to an electrical source to provide power to motor 50 as shown in FIG. 4. Also, a power switch 65 is provided near the front portion of the machine to allow the machine to be easily turned on and off. The power switch is preferably illuminated to provide a clear indication of the status of the machine to the operator. Motor 50 may be any electrical motor capable of effectively rotating shaft 58 to provide the necessary output for driving the system components via a clutch brake 66. Timing belt 62 extends between motor 50 and clutch brake 66 to drive pulley assembly 68. Drive system 26 further includes a cam drive assembly 70 including a camshaft 72 extending between, and mounted in bearings positioned in, first and second side plates 30, 32.

Cam drive assembly 70 also includes a drive pulley 74 mounted on one end of camshaft 72 and positioned on one side of second side plate 32 opposite first side plate 30. A second timing belt 76 extends between pulley assembly 68 of clutch brake 66 and drive pulley 74 for causing rotation of camshaft 72 upon the actuation, i.e. release, of clutch brake 66. Importantly, cam drive assembly 70 also includes a knife or cutting cam 78 for operating cutting device 20, and a feed support or slide cam 80 for operating tape feed support device 22. Cam drive assembly 70 also includes a gear drive 82 for engagement by a drive belt 84 for rotating tape wrap collet 24. As shown in FIG. 2, the slide cam 80 is positioned in a recess 81 formed in gear drive 82 to form a compact drive assembly. A first belt tensioner 85 and a second belt tensioner 87 may be provided to maintain the appropriate tension in first timing belt 62 and second timing belt 76 respectively.

Figure 8A:
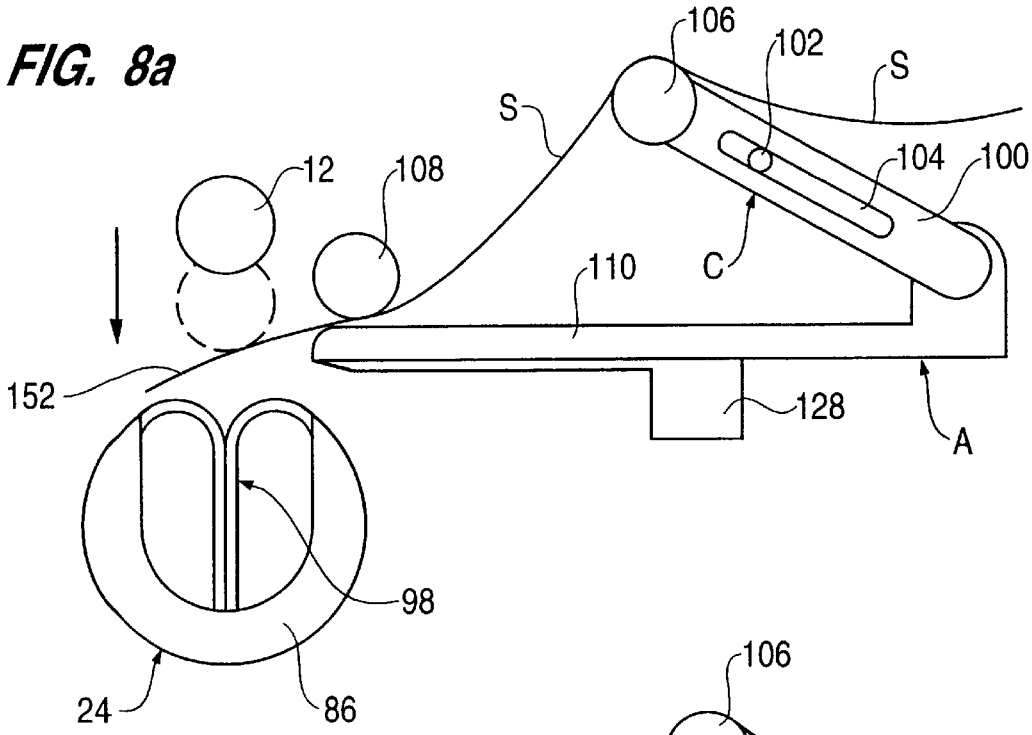
FIGS. 8*a*–8*d* are schematic views of the tape wrap collet, tape slack device, tape feed support device and cutting device of the present invention shown in various stages of operation.

As shown in FIGS. 4 and 8*a*, tape wrap collet includes a C-shaped collet body 86 rotatably mounted in the front upper portion of machine 10 between first and second side plates 30, 32. Tape wrap collet 24 includes resilient grasping fingers or loops 98 for engaging the outer surface of the tape positioned around article 12 as article 12 is pushed between the resilient grasping fingers 98. Grasping fingers 98 should be formed of a material having sufficient flexibility to generally conform to the shape of a substantial portion of the outer surface of article 12 when the article is positioned between fingers 98. Preferably, grasping fingers or loops 98 are formed, at least partially, from a compliant or pliable material, such as an elastomer, foam or plastic material, for providing optimum grasping and conformance to the shape of article 12 thereby creating a tighter tape wrap. For example, grasping fingers 98 could be formed completely of an elastomer material or could be formed of a metal spring material covered with an elastomer outer layer.

As shown in FIG. 4, collet body 86 includes gear teeth 88 formed on the outer surface of its C-shaped periphery for engagement by a drive gear 90. Drive gear 90 is mounted on a rotatable transfer shaft 92 extending between first and second side plates 30, 32. A driven pulley 94 is mounted on transfer shaft 92 adjacent drive gear 90 for engagement with drive belt 84. Two sets of transfer shafts, driven pulleys and drive gears are provided, as shown in FIG. 1, at two different locations around the periphery of tape wrap collet 24 to ensure the desired rotation of collet 24 as the opening of the C-shaped collet passes by one of the drive gears 90 so that at least one drive gear 90 will always be in engagement with gear teeth 88. Drive belt 84 extends from gear drive 82 around one of the driven pulleys 94 and then passes around an intermediate roller 96 before extending around the second driven pulley 94.

Figure 6:
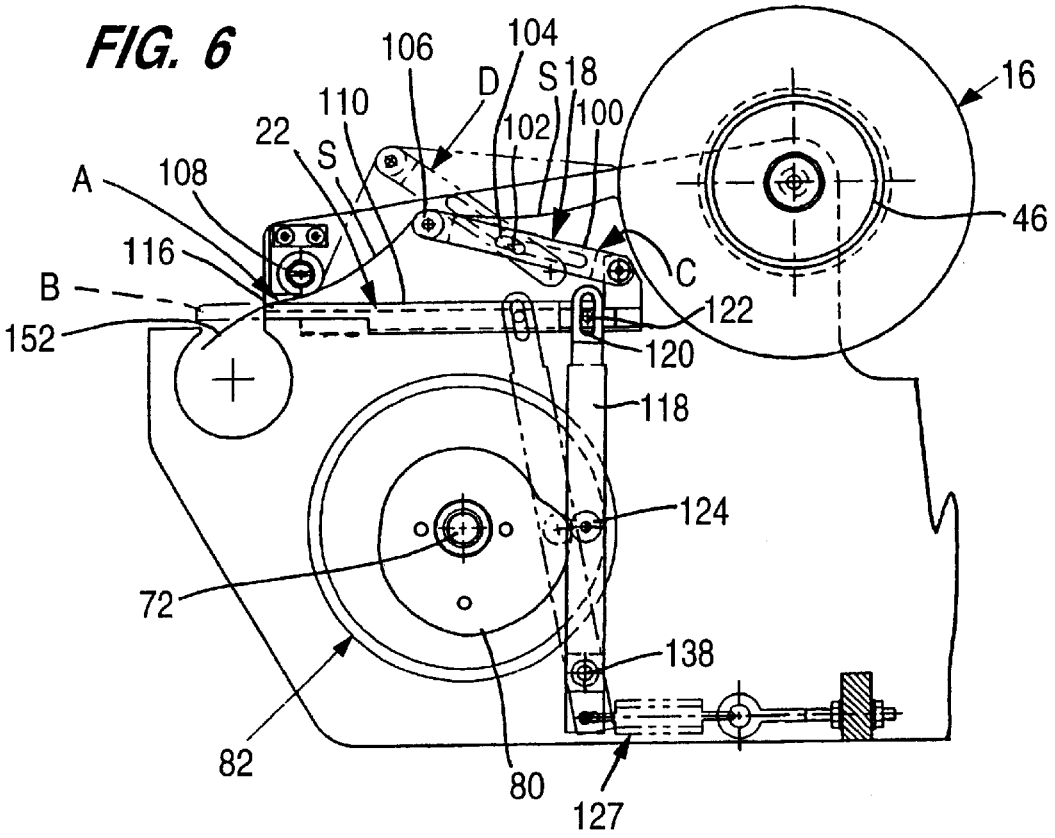
FIG. 6 is a partial cross sectional schematic view taken along plane 6—6 in FIG. 3 showing the tape slack device and tape feed support device of the present invention.

Referring to FIG. 6, tape slack device 18 includes a slack arm 100 pivotally mounted on a pin 102 extending from first side plate 30. Slack arm 100 includes an axial slot 104 for receiving pin 102 thereby allowing slack arm 100 to not only pivot around pin 102 but also move axially thereby permitting the shifting of slack arm 100 into various positions. The outer end of slack arm 100 includes a roller 106 over which the tape extending from tape supply roll 16 passes. The tape web extends from roller 106 to contact the underside of a guide roller 108 for guiding the tape web toward tape wrap collet 24. Guide roller 108 preferably includes a one-way clutch for impeding counterclockwise rotation of guide roller 108 to assist in the control of the movement of the tape web. An end of slack arm 100 opposite roller 106 is pivotally connected to one end of a feed slide 110 of tape feed support device 22.

Figure 3:
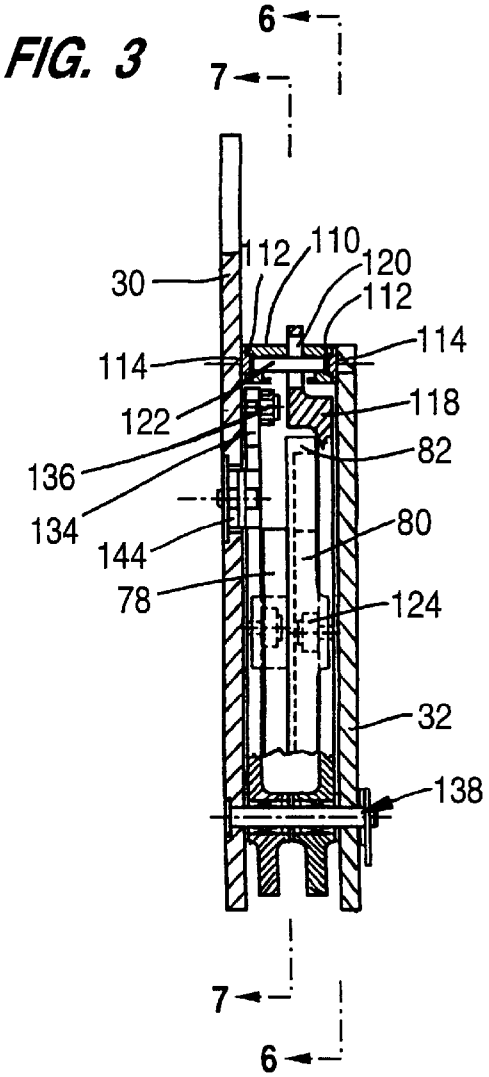
FIG. 3 is a cross sectional view of the present tape wrapping machine taken along plane 3—3 of FIG. 1.

As best shown in FIGS. 2, 3 and 6, feed slide 110 is generally rectangular in cross section and includes an axial groove 112 formed in each side for sliding movement along corresponding rails 114 mounted on opposing faces of first and second side plates 30, 32. Feed slide 110 includes a distal end 116 for supporting the tape web being delivered to tape wrap collet 24 while functioning in cooperation with cutting device 20 to ensure an effective cutting operation. Tape feed support device 22 further includes a tape feed arm 118 having a slot 120 formed at one end for receiving a pin 122 extending from feed slide 110. A cam roller 124 is mounted on tape feed arm 118 intermediate its ends for rolling abutment with the outer cam surface of feed slide cam 80. A lower end of tape feed arm 118 is pivotally connected to first and second side plates 30, 32 via a pivot pin 138. A tape feed biasing spring 127 or any other equivalent biasing mechanism is used to apply biasing force to one end of tape feed arm 118 so as to bias cam roller 124 against cam 80 throughout rotation of cam 80. As shown in FIG. 6, cam 80 is shaped so as to pivot tape feed arm 118 and thereby slidably move feed slide 110 from a retracted position indicated at A to an extended position indicated at B and then return feed slide 110 to the retracted position during one complete rotation of cam 80. Also, during each rotation of feed slide cam 80 and corresponding reciprocation of feed slide 110, slack arm 100 will move between a slack position, indicated at C, providing slack S in the tape web travelling to and from roller 106, and a tension position indicated at D. The tension position not only provides tension in the tape web travelling to and from roller 106 but also importantly lengthens the tape feed path between tape supply roll 16 and guide roller 108 thereby permitting the creation of slack in the web upon movement of the slack arm 100 back to the slack position C near the completion of one cycle of rotation of feed slide cam 80.

Figure 7:
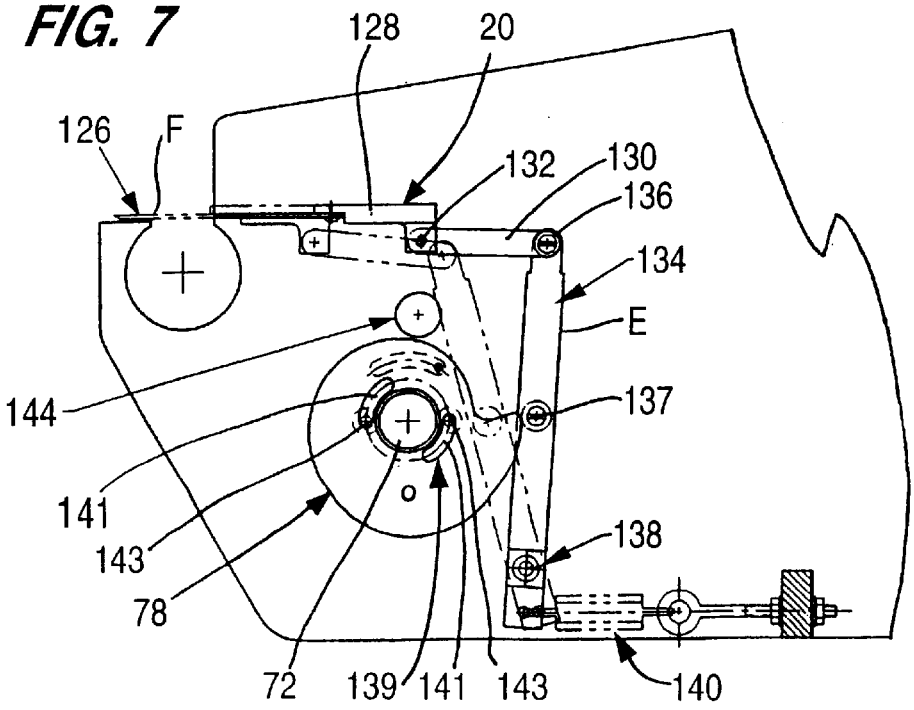
FIG. 7 is a partial cross sectional schematic view taken along plane 7—7 in FIG. 3.

Referring to FIGS. 2 and 7, cutting device 20 includes an elongated knife 126 mounted on a knife slide 128. A link 130 pivotally connected to knife slide 128 by a pin 132 is connected at an opposite end to a swing arm 134 via a pivotal connection 136. A cam roller 137 is mounted on swing arm 134 intermediate its ends for abutment against the outer surface of knife cam 78. The lower end of swing arm 134, shown in FIG. 7, is pivotally connected to first and second side plates 30, 32 via pivot pin 138. In this manner, knife cam 78 includes an outer cam surface or profile designed to move swing arm 134 and thus knife 126 between a retracted position E and an extended position, indicated at F, for cutting the web of tape. As explained more fully hereinbelow, knife cam 78 is fixed on camshaft 72 relative to feed slide cam 80 such that knife 126 moves into the extended position while feed slide 110 is also in the extended position to ensure effective cutting of the tape. An adjustable connection 139, including a pair of slots 141 and lock nuts 143, may be provided to permit the rotational position of knife cam 78 on camshaft 72 to be adjusted to vary the timing of movement of knife 126 into the extended position. Adjustable connection 139 thereby enables control over the length of tape to be wrapped around article 12 thus permitting effective taping of various sized articles and/or control over the number of tape wraps. A biasing device 140, such as a coil spring, connects to the lower end of swing arm 134 to bias cam 136 into abutment against knife cam 78. As shown in FIG. 2, knife slide 128 is positioned in a center channel 142 formed on the underside of feed slide 110. Thus, feed slide 110 also functions to slidably support knife slide 128 during its movement between the extended and retracted positions. Also, a shock damper 144 may be provided to absorb the impact and vibrations induced by cam roller 136 contacting the inner base circle of knife cam 78 as knife 126 moves into the extended position thereby reducing noise and creating smooth operation.

Referring to FIGS. 1 and 5, combination safety guard and actuating device 28 includes a generally L-shaped bracket 146 pivotally mounted on machine 10 by a pivotal connection 148. The vertical portion of bracket 146 functions as a safety guard which is moved between an open position, as shown in FIG. 1, which permits movement of article 12 into tape wrap collet 24 and a closed position as shown in FIG. 5. The horizontal portion of L-shaped bracket 146, as shown in FIG. 1, functions as both an actuating device for actuating machine 10 and as a safety guard operator for moving the vertical portion of device 28 into the closed position as shown in FIG. 5. Article 12 is moved into position against the horizontal portion of L-shaped bracket 146 and pushed into tape wrap collet 24 causing L-shaped bracket 146 to pivot clockwise around pivotal connection 148. An actuating sensor 150, such as a fiber optic sensor, is positioned adjacent tape wrap collet 24 such that when safety guard and actuating device 28 moves into the closed position as shown in FIG. 5, the horizontal portion of L-shaped bracket 146 is sensed by actuating sensor 150 causing clutch brake 66 to release thereby initiating one cycle of operation of machine 10.

Figure 8B:
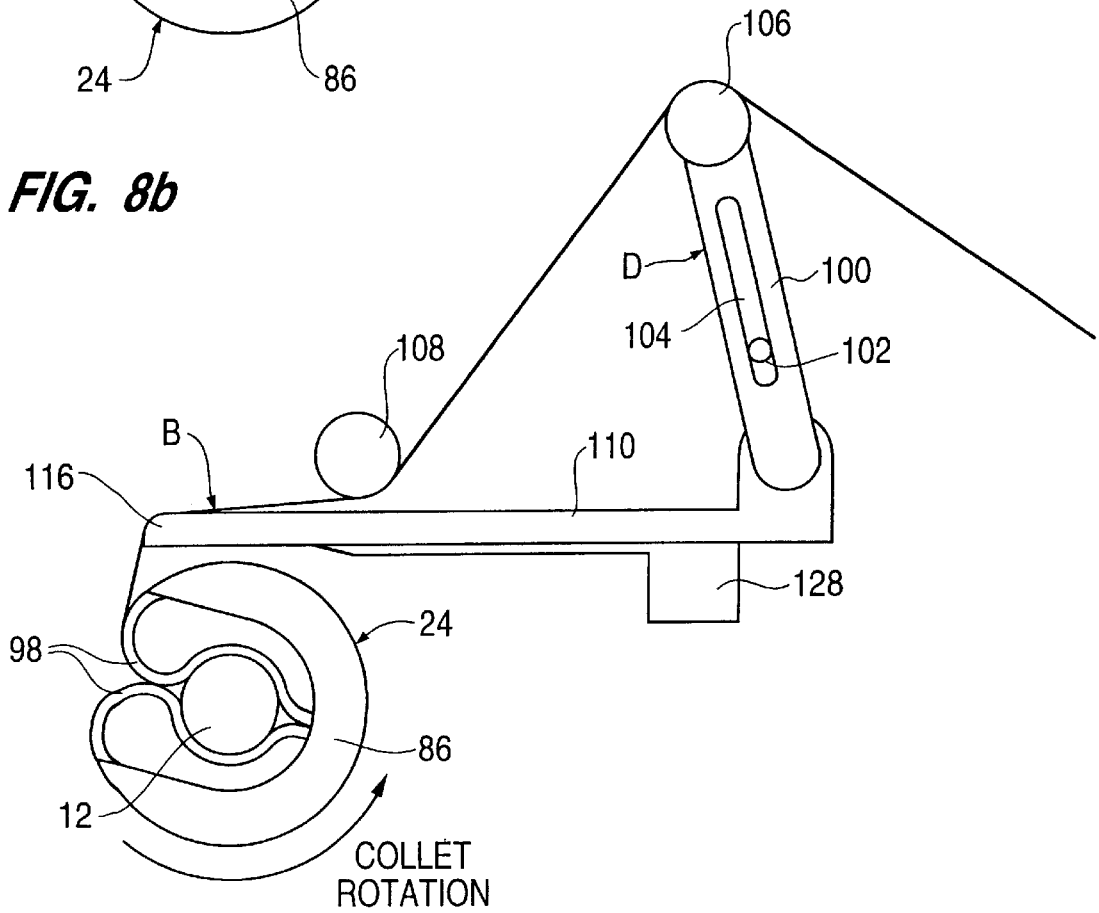
Figure 8C:
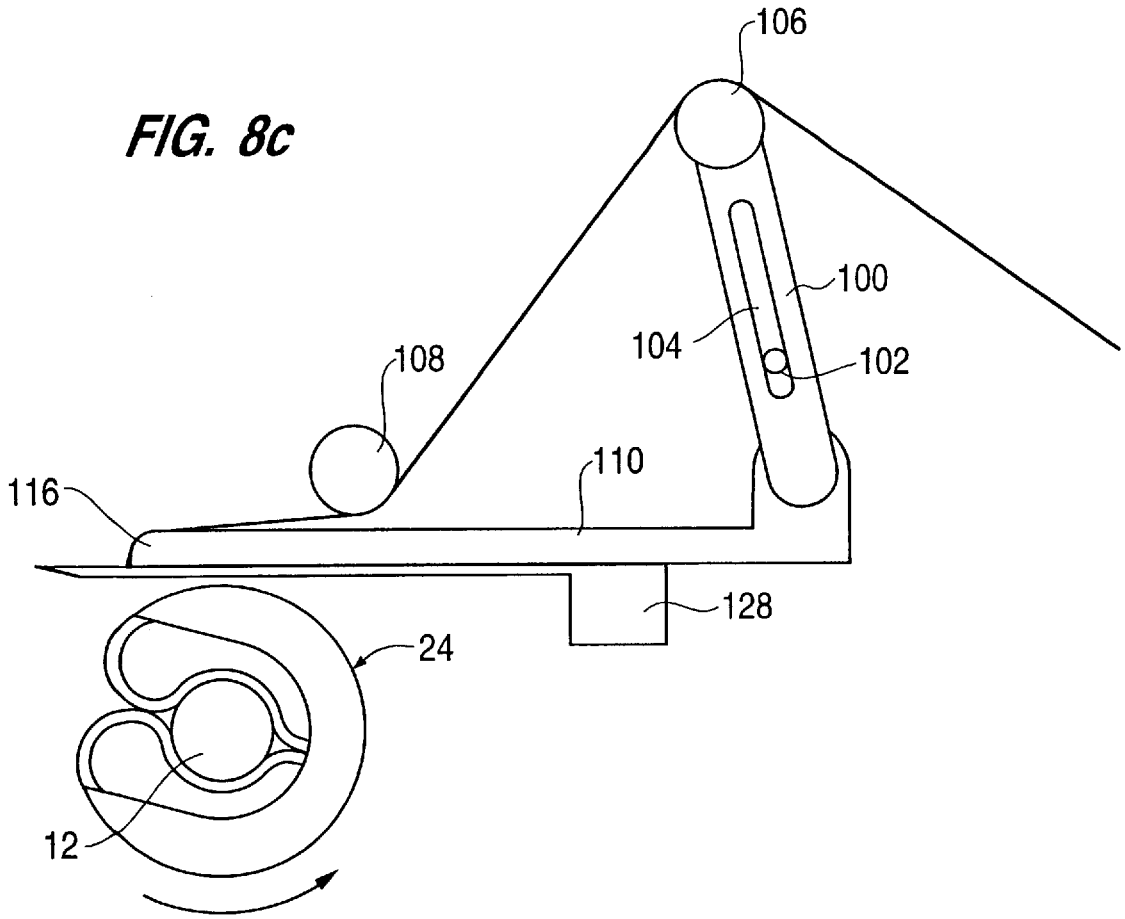
Figure 8D:
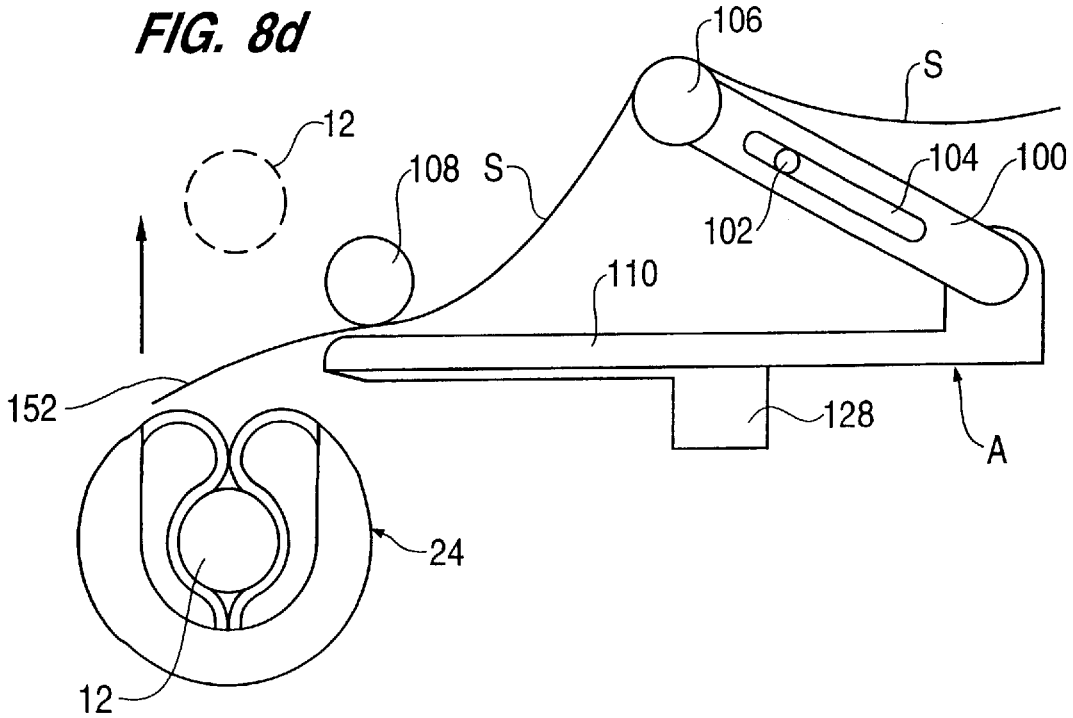

During operation, a tape supply roll 16 is mounted on tape spool 46 and friction brake mechanism 48 adjusted to provide the proper resistance to rotation of tape supply roll 16. With the adhesive side of the tape web facing upwardly as shown in FIG. 1, the tape is pulled over slack arm roller 106 and under guide roller 108 so that an unsupported end portion 152 of the tape web hangs out over tape wrap collet 24. Machine 10 is then turned on by pushing power switch 65 and article 12, such as a bundle of wires, is positioned above tape wrap collet 24. Referring to FIGS. 8*a*–8*d*, with feed slide 110 and knife 126 in the retracted positions, and slack arm 100 in the slack position, article 12 is pushed against the adhesive side of the unsupported end portion 152 of the tape web and further pushed between the resilient grasping fingers 98 of tape wrap collet 24. Fingers 98 conform to the outer shape of article 12 causing the tape to tightly wrap around the outer surface of article 12. As article 12 is moved into tape wrap collet 24, article 12 contacts the horizontal portion of L-shaped bracket 146 of safety guard and actuating device 28 causing the L-shaped bracket to rotate clockwise. As a result, the safety guard covers the access to tape wrap collet 24 while the actuating horizontal portion rotates into position adjacent fiber optic actuating sensor 150. As a result, sensor 150 signals the release of clutch brake 66 permitting rotation of pulley assembly 68, second timing belt 76 and camshaft 72. As the outer portion 152 of the tape web is moved into tape wrap collet 24, the slack in the tape web extending to and from slack arm roller 106 is used to supply the necessary tape to move the tape and article in the collet. Thus, the slack in the tape web along the feed path between tape supply roll 16 and guide roller 108 permits the tape to be easily pulled through the machine without requiring the tape to be pulled from tape supply roll 16 thereby minimizing the effort required by the operator. As camshaft 72 begins to rotate, gear drive 82 and drive belt 84 rotate tape wrap collet 24 as shown in FIG. 8*b* while feed slide cam 80 rotates to cause feed slide 110 to move from the retracted position A to the extended position B while causing slack arm 100 to move from the slack position C of FIG. 8*a* into the tension position D of FIG. 8*b*. As tape wrap collet 24 continues to rotate in the counterclockwise direction as shown in FIG. 8*b*, tape is pulled from tape supply reel 16. Moreover, the movement of tape slack arm 100 into the tension position functions to pull additional tape from tape supply roll 16 to be used to create the slack desirable for the next tape wrapping cycle. As shown in FIG. 8*c*, at a predetermined time during the rotation of camshaft 72, knife cam 78 permits swing arm 134 to pivot around pin 138 (FIG. 7) thereby causing knife slide 128 and the elongated knife 126 to move from the retracted position to the extended position. As the distal end of elongated knife 126 moves past the distal end of feed slide 110, the cutting edge of knife 126 effectively severs the tape web. The feed slide 110 thus effectively supports the tape web and creates a tension in the web necessary for effective cutting by the knife 126. In addition, the extent of feed slide 110 in the extended position determines the length of the unsupported end portion 152. Importantly, the cutting edge of knife 126 is positioned immediately adjacent the distal end of feed slide 110 for effective cutting. Tape wrap collet 24 then continues rotation to cause grasping fingers 98 to tightly wrap the cut length of tape around article 12. Prior to the completed rotation of tape wrap collet 24, feed slide 110 and knife 126 are moved back into the retracted positions causing slack arm 100 to return to the slack position thereby creating the slack S in the tape web on either side of slack arm roller 106 as shown in FIG. 8*d*. Tape wrap collet 24 then completes its rotation and article 12 is removed with a securely wrapped piece of tape. It should be understood that elongated knife 126 may, alternatively, include a filament wire which upon receiving an electrical current, heats to a sufficient temperature for effectively cutting the web of tape.

Thus, the present tape wrapping machine is advantageous in reducing the effort required by the operator to pull the tape from tape supply roll 16 by providing slack S in the tape web along the tape feed path at the end of each cycle of operation while maintaining the desired tension in the tape web during wrapping operations. This design also reduces the risk of the tape pulling off the article as the article is moved into the tape wrap collet by avoiding the unnecessary force, and therefore excessive tape tension, required to pull the tape from the tape supply roll. In conventional machines, this tape tension required to pull the tape from the tape supply roll during movement of the article into the tape wrap collet may cause the tape to pull from the article instead of pulling the tape from the tape supply roll thereby disadvantageously interrupting taping operations. The present machine also provides the appropriate slack while avoiding the need to move the supply roll of tape relative to the collet and thus maintains a fixed spaced distance between the supply roll and the collet thereby creating a less complex tape slack device. In addition, the present machine advantageously cuts the tape web from the nonadhesive side of the tape thereby avoiding the likelihood of the tape adhering to the knife and the complications associated therewith. Moreover, the present invention provides a feed slide/support capable of effectively supporting the web to create reliable cutting while assisting the slack arm in creating sufficient slack for the next cycle of operation. The present tape machine also effectively creates a tight tape wrap by using a compliant material, such as an elastomer, foam or plastic, to form at least a portion of the collet fingers. Moreover, the present system effectively reduces the risk of injury to the operator by preventing operation of the tape wrap collet unless the safety guard and actuator device is in the closed position. Moreover, the combination safety guard and actuator device permits easy automatic operation by automatically initiating each cycle of operation while automatically resetting to the open position when the operator removes the taped article.

I claim:

1. A tape wrapping machine for wrapping pressure sensitive tape around an article, comprising:

a support frame;

a tape supply means mounted on said support frame for providing a web of tape for movement along a feed path;

a tape wrap collet rotatably mounted on said frame a fixed spaced distance from said tape supply means for receiving the article and wrapping a cut length of tape around the article;

a tape slack means for creating a predetermined amount of untensioned slack in the tape web along said feed path while maintaining said fixed spaced distance between said tape wrap collet and said tape supply means, said tape slack means including a slack arm pivotally mounted on said support frame for abutment against the tape web, said slack arm being movable between a tension position maintaining tension in the tape web and a slack position creating untensioned slack in the tape web; and a tape feed support means for supporting the tape web adjacent said tape wrap collet, said tape feed support means including a feed slide reciprocally mounted for movement between an extended position supporting the tape web and a retracted position creating an unsupported end portion of the tape web wherein movement of said feed slide toward said retracted position causes movement of said slack arm toward said slack position, said slack arm being pivotally connected to said feed slide.

2. The tape wrapping machine of claim 1, further including a feed slide cam means for moving said feed slide between said extended and retracted positions and moving said slack arm between said tension and said slack positions.

3. The tape wrapping machine of claim 1, further including a tape cutting means mounted on the machine and positioned for cutting a nonadhesive side of the tape web.

4. The tape wrapping machine of claim 3, wherein said cutting means includes an elongated knife reciprocally mounted adjacent said feed slide and a knife cam means for moving said knife between a first position and a second position, wherein movement of said knife into said second position causes said knife to cut the tape web.

5. The tape wrapping machine of claim 4, wherein said knife cam means moves said knife into said second position when said feed slide is in said extended position.

6. The tape wrapping machine of claim 5, wherein said knife cam means includes an adjusting means for permitting adjustment in a timing of the movement of said knife into said second position relative to rotation of said tape wrap collet to vary said cut length of tape.

7. The tape wrapping machine of claim 1, wherein said tape wrap collet includes resilient grasping means for grasping the article to be wrapped, said resilient grasping means being formed of at least one an elastomer, foam and plastic material for contacting the article.

8. The tape wrapping machine of claim 1, further including a collet rotating means for rotating said tape wrap collet, and a safety guard and actuation means pivotally mounted on said support frame for movement between a closed position blocking access to said tape wrap collet and causing actuation of said collet rotating means and an open position, wherein movement of the article into said tape wrap collet causes movement of said safety guard and actuation means from said open position to said closed position and movement of the article out of said tape wrap collet causes movement of said safety guard and actuation means from said closed position to said open position.

9. A tape wrapping machine for wrapping pressure sensitive tape around an article, comprising:

a support frame;

a tape supply means mounted on said support frame for providing a web of tape for movement along a feed path;

a tape wrap collet rotatably mounted on said frame a fixed spaced distance from said tape supply means for receiving the article and wrapping a cut length of tape around the article;

a tape feed support means for supporting the tape web adjacent said tape wrap collet, said tape feed support means including a feed slide reciprocally mounted for movement between an extended position supporting the tape web and a retracted position creating an unsupported end portion of the tape web;

a tape cutting means mounted on the machine and positioned for cutting only a nonadhesive side of the tape web while avoiding contact with an adhesive side of the tape web, wherein said cutting means includes an elongated knife mounted adjacent said feed slide for reciprocal movement between a first position and a second position, wherein movement of said knife into said second position causes said knife to cut the tape web.

10. The tape wrapping machine of claim 9, wherein said cutting means further includes a knife actuating means for moving said knife into said second position when said feed slide is in said extended position.

11. The tape wrapping machine of claim 10, further including a feed slide cam means operatively connected to said feed slide for moving said feed slide between said extended and retracted positions, said knife actuating means including a knife cam means, said feed slide cam means and said knife cam means being positioned adjacent one another.

12. The tape wrapping machine of claim 11, wherein said knife cam means includes an adjusting means for permitting adjustment in a timing of the movement of said knife into said second position relative to rotation of said tape wrap collet to vary said cut length of tape.

13. The tape wrapping machine of claim 10, further including a tape slack means for creating a predetermined amount of untensioned slack in the tape web along said feed path, said tape slack means including a slack arm pivotally mounted on said support frame for abutment against the tape web, said slack arm being movable between a tension position maintaining tension in the tape web and a slack position creating untensioned slack in the tape web.

14. The tape wrapping machine of claim 13, wherein said slack arm is pivotally connected to said feed slide and movement of said feed slide toward said retracted position causes movement of said slack arm toward said slack position.

15. The tape wrapping machine of claim 9, wherein said tape wrap collet including resilient grasping means for grasping the article to be wrapped, said resilient grasping means being formed of at least one an elastomer, foam and plastic material for contacting the article.

16. The tape wrapping machine of claim 9, further including a collet rotating means for rotating said tape wrap collet, and a safety guard and actuation means pivotally mounted on said support frame for movement between a closed position blocking access to said tape wrap collet and causing actuation of said collet rotating means and an open position, wherein movement of the article into said tape wrap collet causes movement of said safety guard and actuation means from said open position to said closed position and movement of the article out of said tape wrap collet causes movement of said safety guard and actuation means from said closed position to said open position.

17. The tape wrapping machine of claim 9, wherein said feed slide includes a lower surface facing said tape wrap collet when said feed slide is in said extended position, said knife including an upper surface positioned in sliding abutment against said lower surface of said feed slide.

18. A tape wrapping machine for wrapping pressure sensitive tape around an article, comprising:

a support frame;

a tape supply means mounted on said support frame for providing a web of tape for movement along a feed path;

a tape wrap collet rotatably mounted on said frame a fixed spaced distance from said tape supply means for receiving the article and wrapping a cut length of tape around the article; and a tape slack means for creating a predetermined amount of untensioned slack in the tape web along said feed path while maintaining said fixed spaced distance between said tape wrap collet and said tape supply means, said tape slack means including a slack arm pivotally mounted on said support frame for abutment against the tape web, said slack arm being movable between a tension position maintaining tension in the tape web and a slack position creating untensioned slack in the tape web;

further including a collet rotating means for rotating said tape wrap collet, and a safety guard and actuation means pivotally mounted on said support frame for movement between a closed position blocking access to said tape wrap collet and causing actuation of said collet rotating means and an open position, wherein movement of the article into said tape wrap collet causes movement of said safety guard and actuation means from said open position to said closed position and movement of the article out of said tape wrap collet causes movement of said safety guard and actuation means from said closed position to said open position.

19. A tape wrapping machine for wrapping pressure sensitive tape around an article, comprising:

a support frame;

a tape supply means mounted on said support frame for providing a web of tape for movement along a feed path;

a tape wrap collet rotatably mounted on said frame a fixed spaced distance from said tape supply means for receiving the article and wrapping a cut length of tape around the article;

a tape feed support means for supporting the tape web adjacent said tape wrap collet, said tape feed support means including a feed slide reciprocally mounted for movement between an extended position supporting the tape web and a retracted position creating an unsupported end portion of the tape web;

a tape cutting means mounted on the machine and positioned for cutting a nonadhesive side of the tape web, wherein said cutting means includes an elongated knife mounted adjacent said feed slide for reciprocal movement between a first position and a second position, wherein movement of said knife into said second position causes said knife to cut the tape web;

further including a collet rotating means for rotating said tape wrap collet, and a safety guard and actuation means pivotally mounted on said support frame for movement between a closed position blocking access to said tape wrap collet and causing actuation of said collet rotating means and an open position, wherein movement of the article into said tape wrap collet causes movement of said safety guard and actuation means from said open position to said closed position and movement of the article out of said tape wrap collet causes movement of said safety guard and actuation means from said closed position to said open position.

20. A tape wrapping machine for wrapping pressure sensitive tape around an article, comprising:

a support frame;

a tape supply means mounted on said support frame for providing a web of tape for movement along a feed path;

a tape wrap collet rotatably mounted on said frame a fixed spaced distance from said tape supply means for receiving the article and wrapping a cut length of tape around the article;

a tape feed support means for supporting the tape web adjacent said tape wrap collet, said tape feed support means including a feed slide reciprocally mounted for movement between an extended position supporting the tape web and a retracted position creating an unsupported end portion of the tape web;

a tape cutting means mounted on the machine and positioned for cutting a nonadhesive side of the tape web, wherein said cutting means includes an elongated knife mounted adjacent said feed slide for reciprocal movement between a first position and a second position, wherein movement of said knife into said second position causes said knife to cut the tape web;

wherein said feed slide includes a lower surface facing said tape wrap collet when said feed slide is in said extended position, said knife including an upper surface positioned in sliding abutment against said lower surface of said feed slide.

* * * * *

UNITED STATES PATENT AND TRADEMARK OFFICE

CERTIFICATE OF CORRECTION

PATENT NO. : 5,954,918

DATED : September 21, 1999

INVENTOR(S) : Thomas U. Belivakici

It is certified that error appears in the above-identified patent and that said Letters Patent is hereby corrected as shown below:

On the title page, under item [73] Assignee, delete "Philadelphia" and insert therefor --Hanover--.

Signed and Sealed this

First Day of May, 2001

*Attest:*

Nicholas P. Godici

NICHOLAS P. GODICI

*Attesting Officer*

*Acting Director of the United States Patent and Trademark Office*